US008973785B2

(12) United States Patent
Newman et al.

(10) Patent No.: US 8,973,785 B2
(45) Date of Patent: Mar. 10, 2015

(54) SYSTEMS AND METHODS FOR PRIMING OR PURGING A PRODUCT DISPENSER

(75) Inventors: David R. Newman, Atlanta, GA (US); Gene M. Farrell, Duluth, GA (US)

(73) Assignee: The Coca-Cola Company, Atlanta, GA (US)

( * ) Notice: Subject to any disclaimer, the term of this patent is extended or adjusted under 35 U.S.C. 154(b) by 1134 days.

(21) Appl. No.: 12/892,497

(22) Filed: Sep. 28, 2010

(65) Prior Publication Data

US 2012/0074168 A1 Mar. 29, 2012

(51) Int. Cl.
*B67D 7/74* (2010.01)
*B67D 1/00* (2006.01)

(52) U.S. Cl.
CPC ..... *B67D 1/0022* (2013.01)
USPC ..... 222/129.4; 222/135

(58) Field of Classification Search
USPC ..... 222/129.4, 129, 132, 135, 145.1, 145.2
See application file for complete search history.

(56) References Cited

U.S. PATENT DOCUMENTS

| | | | | |
|---|---|---|---|---|
| 4,377,246 | A | 3/1983 | McMillin et al. | |
| 5,433,349 | A | 7/1995 | Romanyszyn, Jr. | |
| 2006/0118581 | A1* | 6/2006 | Clark | 222/333 |
| 2007/0257059 | A1* | 11/2007 | Stevenson | 222/129.4 |
| 2007/0267441 | A1* | 11/2007 | van Opstal et al. | 222/129.4 |
| 2008/0206429 | A1* | 8/2008 | Guerrero et al. | 426/590 |
| 2009/0020553 | A1* | 1/2009 | Litterst et al. | 222/1 |
| 2009/0069934 | A1* | 3/2009 | Newman et al. | 700/239 |

FOREIGN PATENT DOCUMENTS

| | | | |
|---|---|---|---|
| CN | 101668695 | A | 3/2010 |
| EP | 2192077 | A1 | 6/2010 |
| WO | 2006101394 | A2 | 9/2006 |
| WO | 2007107704 | A1 | 9/2007 |
| WO | 2008112414 | A2 | 9/2008 |

OTHER PUBLICATIONS

Search Report and Written Opinion for International Application No. PCT/US2011/052564 mailed Dec. 28, 2011.
Chinese Office Action for Application No. 201180046872.6 of Sep. 21, 2011 mailed May 6, 2014.

* cited by examiner

*Primary Examiner* — Kevin P Shaver
*Assistant Examiner* — Robert Nichols, II
(74) *Attorney, Agent, or Firm* — Merchan & Gould P.C.

(57) ABSTRACT

Embodiments of the invention include systems and methods for priming or purging a product dispenser. In one embodiment, a product dispenser can include a plurality of beverage ingredient sources comprising a respective beverage ingredient; a plurality of beverage supply lines in respective communication with the plurality of ingredient sources; at least one pump in communication with the plurality of beverage supply lines; and a controller in communication with the at least one pump and operable to execute a set of instructions operable to: receive a command to prime or purge the product dispenser; and activate the at least one pump, wherein a predefined amount of the respective beverage ingredients is simultaneously introduced into each of the plurality of beverage supply lines.

17 Claims, 3 Drawing Sheets

SYSTEMS AND METHODS FOR PRIMING OR PURGING A PRODUCT DISPENSER

TRADEMARKS

COCA-COLA® is a registered trademark of The Coca-Cola Company, Atlanta, Ga., U.S.A. Other names, symbols, designs, or logos used herein may be registered trademarks, trademarks or product names of The Coca-Cola Company or other companies.

TECHNICAL FIELD OF THE INVENTION

This invention relates to product dispensers, and in particular, relates to systems and methods for priming or purging a product dispenser.

BACKGROUND OF THE INVENTION

Conventional product dispensers can pour a beverage by combining a syrup, sweetener, and/or water. To create a finite variety of beverage selections different kinds of syrup can be offered. This typically results in being able to offer a finite number of branded and non-branded beverage selections. As an example, a single prior art dispenser using several different kinds of syrup might be able to offer limited choices of COCA-COLA™, DIET COCA-COLA™, SPRITE™, and a few other branded or non-branded beverage selections.

One problem with these types of conventional product dispensers is that only a limited number of drinks can be offered. As such, conventional product dispensers may be limited in being able to offer the consumer what they want. In this regard, consumers want a wider menu of beverage selections and the ability to customize their beverage. Research suggests that they want more beverage variations even for a traditional branded beverage. For example, offering COCA-COLA™, COCA-COLA™ with lime, CHERRY COCA-COLA™, VANILLA COCA-COLA™ and numerous other types of COCA-COLA™ beverage variations. Offering all the variations possible for a single drink brand such as COCA-COLA™ are impractical in conventional product dispensers in part because conventional product dispensers have limited capacity and selection capability. They may not offer the consumer what the consumer wants, that is, a complete variety of choices for all types of branded and non-branded beverages.

Product dispensers historically have worked by combining a diluent (such as water) with a beverage base. These beverage bases usually have a reconstitution ratio of about 3:1 to 6:1. The beverage bases usually come in large containers that require large amounts of storage space and may need to be refrigerated. These requirements often necessitate the need to store these containers far from the actual dispenser and to run long lines from the containers to the dispenser.

Given the improvements in shelf life and concentration described above, there is a desire for a product dispenser that can produce even more and different types of beverages while using a smaller footprint. This can be accomplished by breaking down the traditional beverage bases into constituent parts at much higher reconstitution ratios. These parts can then be stored in much smaller packages and stored closer to, adjacent to, or within the product dispenser itself. The product dispenser preferably can give the consumer multiple beverage options such that the consumer has the ability to customize his or her beverage as desired.

In certain instances, any number of beverages may become "sold out," wherein the associated container for a particular beverage base or flavor becomes empty or near empty after the original amount of beverage base or flavor in the container is used. When a sold out condition occurs, an air pocket or air bubble may be introduced into a portion of an associated beverage supply line between the container and a dispensing nozzle. If a new container for the particular beverage base or flavor is connected to the beverage supply line, a product dispenser operator may have to "prime" the product dispenser to clear out the air pocket or air bubble from the portion of supply line. This can be performed by operating the product dispenser and selecting the particular beverage associated with the new container. In conventional product dispensers, the priming operation for each new container is a time consuming, manually initiated operation that requires the operator to individually prime each supply line for each newly installed container. In some instances, when multiple containers are installed, the priming operation for multiple containers can take several minutes since the operator must successively prime each container before the product dispenser is ready for further operation.

SUMMARY OF THE INVENTION

Some or all of the above needs and/or problems may be addressed by embodiments of the invention. Embodiments of the invention can include systems and methods for priming or purging a product dispenser. In one embodiment, a system or product dispenser can include a plurality of beverage ingredient sources comprising a respective beverage ingredient; a plurality of beverage supply lines in respective communication with the plurality of ingredient sources; at least one pump in communication with the plurality of beverage supply lines; and a controller in communication with the at least one pump and operable to execute a set of instructions operable to: receive a command to prime or purge the product dispenser; and activate the at least one pump, wherein a predefined amount of the respective beverage ingredients is simultaneously introduced into each of the plurality of beverage supply lines.

Another embodiment can provide a method for priming or purging a product dispenser. In this embodiment, a method for priming or purging a product dispenser can include providing a plurality of beverage ingredient sources comprising a respective beverage ingredient; providing a plurality of beverage supply lines in respective communication with the plurality of ingredient sources; providing at least one pump in communication with the plurality of beverage supply lines; and providing a controller in communication with the at least one pump and operable to execute a set of instructions operable to: receive a command to prime or purge the product dispenser; and activate the at least one pump, wherein a predefined amount of the respective beverage ingredients is simultaneously introduced into each of the plurality of beverage supply lines.

In yet another embodiment, a method for operating a product dispenser with a plurality of beverage ingredient sources comprising a respective beverage ingredient, a plurality of beverage supply lines in respective communication with the plurality of ingredient sources, and at least one pump in communication with the plurality of beverage supply lines can be provided. The method can include receiving a command to prime or purge the product dispenser; and activating the at least one pump, wherein a predefined amount of the respective beverage ingredients is simultaneously introduced into each of the plurality of beverage supply lines.

Additional systems, methods, product dispensers, apparatus, aspects, and features are realized through the techniques of various embodiments of the invention. Other embodiments, aspects, and features of the invention are described in detail herein and are considered a part of the claimed invention. Other embodiments, aspects, and features can be understood with reference to the description and to the drawings.

Figure 1:
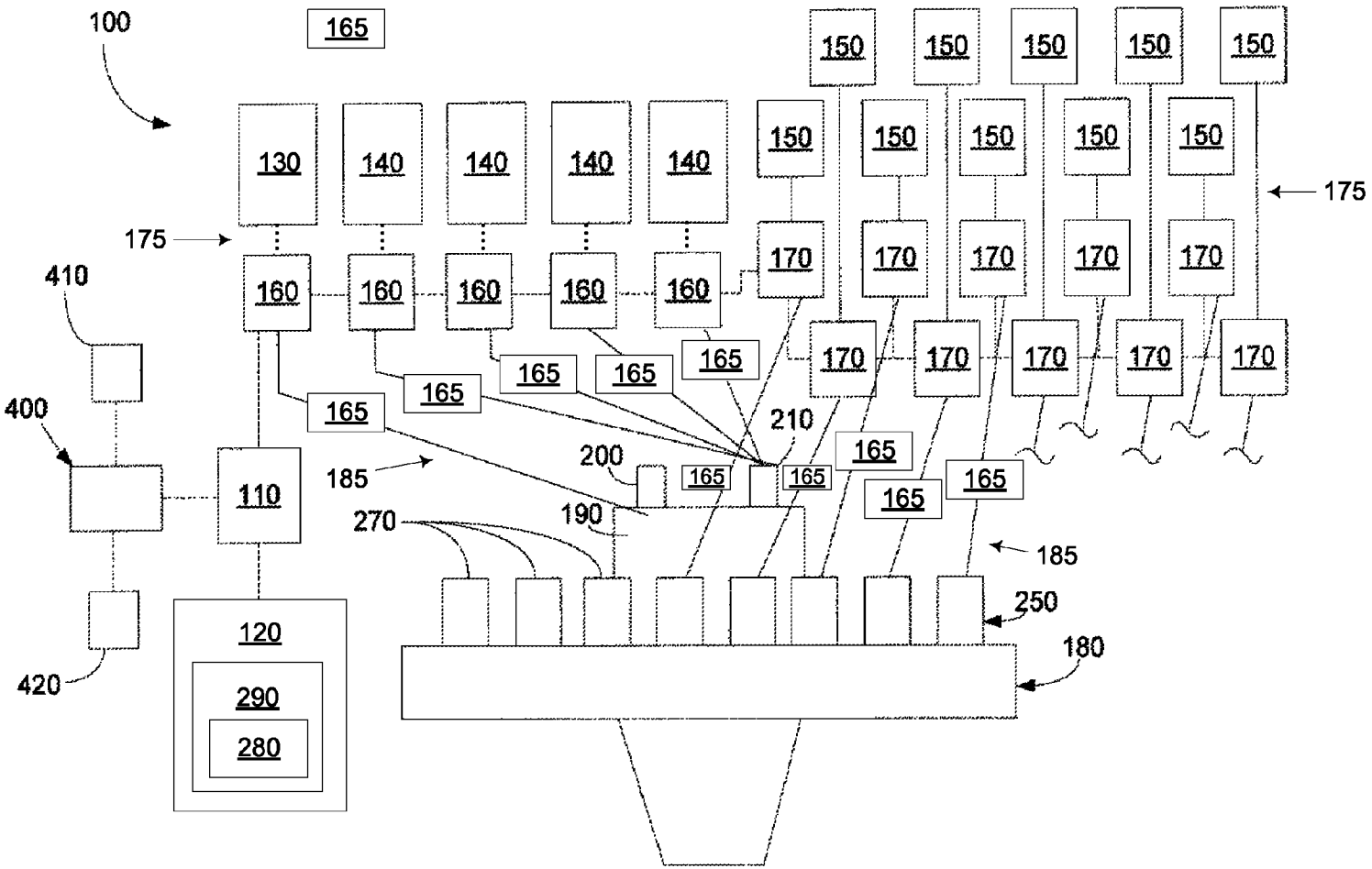
FIG. 1 is a schematic view of an example product dispenser in accordance with an embodiment of the invention.

The detailed description explains various embodiments of the invention, together with aspects and features, by way of example with reference to the drawings.

DETAILED DESCRIPTION OF EMBODIMENTS OF THE INVENTION

As used herein, the terms "beverage forming dispenser", "product dispenser", "beverage dispenser", "dispenser apparatus", and "dispenser" refer to a device which dispenses a product such as a beverage, a fluid, or a consumable product.

As used herein, the terms "product" and "beverage", and their pluralized forms, are used synonymously, and embodiments of the invention should not be limited in scope by the use of either term.

As used herein, the terms "prime" and "priming" refer to an operation used to clear out air, fluid, other substances or materials, or any combination thereof from a portion of supply line between a source and a dispensing nozzle. For example, priming or a prime operation can include introducing a fluid, for instance, a relatively small fluid amount of about 5 ml, into a supply line between a beverage source and a sensor disposed between the source and a dispensing nozzle, wherein the sensor can detect flow of the fluid introduced into the supply line. In certain instances, the sensor can detect a no or low flow condition in the supply line, a condition which may also be called a "sold out" condition. Upon or after priming or a prime operation, the sensor can detect fluid in the supply line, and thereby reset the sensor for subsequent detection of any no or low flow conditions.

As used herein, the terms "purge" and "purging" refer to an operation used to clear out air, fluid, other substances or materials, or any combination thereof from a supply line between a source and a dispensing nozzle. For example, purging or a purge operation can include introducing a fluid, for instance, a relatively larger fluid amount of about 60 ml, into a supply line between a beverage source and a dispensing nozzle, wherein the supply line is substantially filled with the fluid between the beverage source and the dispensing nozzle. In certain embodiments, purging or a purge operation can be used when ingredient sources are switched for a particular supply line, when the product dispenser is initially started upon installation of all new ingredients, when the product dispenser is initially started after manufacture for cleaning or testing, or to clear any shipping fluid from the supply lines.

Embodiments of the invention can include systems and methods for priming or purging a product dispenser. Certain embodiments of the invention can be particularly useful when operating a product dispenser, such as a beverage dispenser. In one instance, when an ingredient source is exhausted or otherwise depleted, air can be introduced into a portion of an associated supply line between the source and a dispenser nozzle associated with the product or beverage dispenser. In certain instances, a user or product dispenser operator may find it inconvenient to replace the ingredient source until multiple ingredient sources need to be replaced due to exhaustion or depletion. In this instance, the user or product dispenser operator may decide to replace the exhausted or depleted ingredient sources in a successive manner. Upon restart of the product or beverage dispenser, rather than successively prime each newly installed ingredient source and associated supply line, which can be time consuming, the user or product dispenser operator can use a one button prime command to simultaneously introduce a predefined amount of each ingredient into associated beverage supply lines between the newly installed ingredient sources and the dispenser nozzle, such as between the newly installed ingredient sources and a respective sensor. In this manner, any air or other substance that may be detected by a sensor associated with each supply line can be flushed out and replaced with relatively new ingredients from the newly installed ingredient sources, which can, in turn, reset the sensors and permit the product or beverage dispenser to dispense the newly installed ingredient sources. Thus, certain embodiments of the invention can provide a technical solution to the time consuming problem of successively priming the supply lines by flushing and replacing air from the supply lines in a product dispenser, such as a beverage dispenser.

In another instance, upon initial startup of a product dispenser, or in some instances, upon startup after prolonged maintenance, all new ingredient sources may be installed in a product dispenser. Rather than successively purge each newly installed ingredient source and associated supply line, which can be time consuming, the user or product dispenser operator can use a one button purge command, or a "Hyperstart"™ command, to simultaneously introduce a predefined amount of each ingredient into associated supply lines between the newly installed ingredient sources and the dispenser nozzle. In this manner, any air, shipping fluids, and/or sanitizing fluids, or relatively older ingredients within the supply lines can be flushed out and replaced with relatively new ingredients from the newly installed ingredient sources. Thus, certain embodiments of the invention can provide a technical solution to the time consuming problem of successively purging newly installed ingredient sources and associated supply lines in a product dispenser, such as a beverage dispenser.

The circumstances provided above are for illustration only, and are not intended to be limiting. One will recognize other circumstances for applying embodiments of the invention, and the applicability of those embodiments to other product and/or beverage dispenser technologies.

Turning now to the drawings in greater detail, in which like numerals indicate like elements throughout the several views, FIG. 1 shows an example system such as a product dispenser 100 as is described herein. A user interface 110 may control some or all of the functional aspects of the product dispenser 100. A consumer may select and/or create numerous types of beverages, blends, and additives using the user interface 110. Furthermore, a food service employee and/or dispenser technician may use the user interface to implement certain installation and/or maintenance functions. A control device 120 may support the user interface 110. The control device 120 may be a conventional microcomputer, processor, or a similar type of device. The control device 120 may be internal to or remote from the product dispenser 100.

The product dispenser 100 may use any number of different ingredients. In this example, several different types of ingredients may be used: water (plain and/or carbonated)

from a water source 130; macro-ingredients from a number of macro-ingredient sources 140; and micro-ingredients from a number of micro-ingredient sources 150. Any number or combinations of sources 130, 140, 150 may be used herein. For example, it may not be necessary to have a macro-ingredient source, e.g., HFCS (High Fructose Corn Syrup), which is difficult to pump at high reconstitution ratios, may not be used. As such, only a diluent and a micro-ingredient source may be required. In another example, 106 unique ingredient sources 140, 150 may be present in a product dispenser, such as 100, in accordance with an embodiment of the invention. One will recognize that other embodiments of the invention can include fewer or greater numbers of ingredient sources 140, 150.

The water from the water source 130 may or may not be refrigerated. Other types of diluents may be used herein. A conventional carbonator or a similar type of device may be used to produce carbonated water as desired. The amount of carbonation may be varied.

Generally described, the macro-ingredients may have reconstitution ratios in the range of about 3:1 to about 6:1. The viscosities of the macro-ingredients typically range from about 100 centipoise or higher. Macro-ingredients may include sugar syrup, HFCS, juice concentrates, and similar types of fluids. Similarly, a macro-ingredient base product may include sweetener, acid, and other common components. The syrups, sweeteners, and base products generally can be stored in a conventional bag-in-box container remote from the dispenser 100. The macro-ingredients also may be positioned within the product dispenser 100 itself. Any type of container may be used herein in accordance with embodiments of the invention. The macro-ingredients may or may not need to be refrigerated.

The micro-ingredients may have a reconstitution ratio ranging from about ten to one (10:1), twenty to one (20:1), thirty to one (30:1), or higher. Specifically, many micro-ingredients may be in the range of fifty to one (50:1) to three hundred to one (300:1). The viscosities of the micro-ingredients typically range from about 1 to about 100 centipoise or so. Examples of micro-ingredients include natural and artificial flavors; flavor additives; natural and artificial colors; artificial sweeteners (high potency or otherwise); additives for controlling tartness, e.g., citric acid, potassium citrate; functional additives such as vitamins, minerals, herbal extracts; nutraceuticals; and over-the-counter (or otherwise) medicines such as acetaminophen and similar types of materials. As described above, the acid and non-acid components of the non-sweetened concentrate also may be separated and stored individually. The micro-ingredients may be liquid, powder (solid), or gaseous form and/or combinations thereof. The micro-ingredients may or may not require refrigeration. Non-beverage substances such as paints, dyes, oils, cosmetics, etc., also may be used. Various types of alcohols may be used as micro or macro-ingredients.

In certain instances, the micro-ingredients and the micro-ingredient sources 150 may be positioned within or about the product dispenser 100 itself as opposed to being remotely positioned in conventional bag in box containers or otherwise. By being positioned about the dispenser, the micro-ingredient sources 150 can, for example, be positioned in close proximity to the dispenser 100 such as adjacent thereto, underneath, or in other near by positions. Any other type of storage arrangements may be used in accordance with embodiments of the invention. The macro and/or micro-ingredient sources may optionally be located remotely from the dispenser 100, such as in a back room, connected to the dispenser 100 with conventional tubing. Furthermore, any type of container may be used herein in accordance with embodiments of the invention.

The water source 130, the macro-ingredient sources 140, and the micro-ingredient sources 150 each may be in communication with a respective pump 160, sensor 165, and/or a metering device 170 via a respective supply line 175. The control device 120 may control the pumps 160, sensors 165, and metering devices 170. Generally described, the water source 130 and the macro-ingredient sources 140 each may be in communication with one of the pumps 160. The pump 160 may be a conventional solenoid pump or a similar type of device.

The micro-ingredient sources 150 each may be in communication with a respective metering device 170 via a respective supply line 175. The metering device 170 may be a positive displacement pump or a similar type of device. Such a positive displacement pump provides portion control for the more highly concentrated micro-ingredients. An example of the operation of a positive displacement pump is shown in commonly owned U.S. patent application Ser. No. 11/276,548, entitled "Pump System with Calibration Curve" incorporated herein by reference.

For example, the positive displacement pump may be a solenoid pump, a gear pump, an annular pump, a peristaltic pump, a syringe pump, a piezo pump or any other type of positive displacement device that is designed to pump a fixed displacement for each pump cycle.

The pumps 160, sensors 165, and the metering devices 170 may be in communication with a dispensing nozzle 180 via respective supply lines 185. The dispensing nozzle 180 preferably may be a multi-flavor dispensing valve capable of mixing a number of fluids at the same time. Examples of dispensing nozzles that may be used herein are shown in commonly owned U.S. patent application Ser. No. 10/233,867 (U.S. Patent Publication No. US 2004/0040983 A1), entitled "Dispensing Nozzle" and commonly-owned U.S. patent application Ser. No. 11/276,551, entitled "Dispensing Nozzle Assembly". Collectively or individually, the supply lines 175, 185 can be known as beverage supply lines.

The sensors 165 can be operable to detect a no or low flow condition in the respective supply lines 175, 185, and can communicate a corresponding signal to the control device 120 when a no or low flow condition is detected. The control device 120 can generate an indication that a no or low flow condition exists with the respective supply lines 175, 185. For example, upon receipt of an indication from a control device 120 that a no or low flow condition exists in a particular supply line such as 175 or 185, the control device 120 can output a signal to a user, for instance via a user interface such as 304 in FIG. 3, that a certain product or ingredient has a no or low flow condition in the associated supply line. This signal may be an indicator that the certain product or ingredient has been exhausted or is in a "sold out" condition. The sensors 165 in FIG. 1 are shown positioned with respect to a supply line, such as 175, 185, for each ingredient source 140, 150. One will recognize that the sensors 165 can be positioned in any location with respect to a supply line 175, 185 between at least one ingredient source 140, 150 and a dispenser nozzle, such as 180.

In certain embodiments, when a "sold out" condition occurs for a particular product or ingredient, the missing ingredient can affect beverage taste and/or beverage quality, and therefore, the associated product dispenser, such as 100, may altogether stop or otherwise cease attempting to dispense the particular product or ingredient. A control device, such as 120, can provide a user or operator with an opportunity to reset the sensor 165 upon correction of the "sold out" condition for the one or more particular products or ingredients. In this manner, a prime or priming operation can be performed for the "sold out" product or ingredient which "resets" the associated sensor 165, and permits the product dispenser, such as 100, to again permit dispensing of the particular product or ingredient.

Generally shown in FIG. 1, the dispensing nozzle can include a flow director 190 with a number of conduits extending therethrough. In this example, the flow director 190 may have a first conduit 200 and a second conduit 210 extending therethrough. The first conduit 200 may be used for water, other types of diluents, or other fluids. The second conduit 210 may be used for a macro-ingredient such as sweetened concentrate, sugar syrup, HFCS syrup, juice concentrate, or other type of fluids. Positioned beneath the flow director 190 may be a target, which may include a number of vertically extending fins that form a number of U- or V-shaped channels. The water, the macro-ingredients, or other fluids may flow out of the flow director 190 and down along the channels of the target so as to begin mixing.

Positioned adjacent to the flow director 190 may be a tertiary flow assembly 250. The tertiary flow assembly 250 may include a number of modules, which may have a number of conduits 270 extending therethrough. The conduits 270 may have differing sizes and configurations depending upon the nature of the intended flow therethrough. The modules may be replaceable and interchangeable. Each of the modules and the conduits 270 may be in communication with one of the micro-ingredient sources 150 or other types of fluids. The conduits 270 may be aimed towards the target so as to mix the micro-ingredients or other fluid with the water, the macro-ingredients, or other fluid. Any number of micro-ingredients or other types of fluids may be used at the same time.

As stated above, the control device 120 may be, for example, a processor or controller. The control device 120 may include one or more computer-executable instructions 280 stored in an associated memory, such as 290, or other computer-readable medium. The computer-executable instructions can include instructions operable to receive a command to prime the product dispenser, and to activate the at least one pump, wherein a predefined amount of the respective beverage ingredients is simultaneously introduced into each of the plurality of beverage supply lines.

In at least one embodiment, wherein a product dispenser includes a respective pump for each of a plurality of beverage ingredient sources, a control device 120, such as a controller, may be in communication with each of the respective pumps. In this embodiment, the control device 120, such as a controller, can further include computer-executable instructions operable to activate each of the respective pumps, wherein a predefined amount of the respective beverage ingredients is simultaneously introduced into each of the plurality of beverage supply lines. In one example, a predefined amount can be an amount sufficient to clear each of the plurality of beverage supply lines of any air pocket between the respective beverage ingredient source and a respective sensor associated with each of the plurality of beverage supply lines. In another example, a predefined amount can be an amount sufficient to clear each of the plurality of beverage supply lines of any air pocket between the respective beverage ingredient source and the dispensing nozzle.

In at least one embodiment, a control device 120, such as a controller, can further include computer-executable instructions operable to receive a selection of more than one of a plurality of beverage supply lines to prime. In this embodiment, the control device 120, such as a controller, can activate each of the respective pumps for the selected beverage supply lines, wherein a predefined amount of the respective beverage ingredients is simultaneously introduced into each of the selected beverage supply lines. In certain embodiments, the control device 120, such as a controller, can activate each of the respective pumps for all of the beverage supply lines, wherein a predefined amount of the respective beverage ingredients is simultaneously introduced into each of the selected beverage supply lines. In one example, a predefined amount can be an amount sufficient to clear each of the selected beverage supply lines of any air pocket between the respective beverage ingredient source and a respective sensor associated with each of the selected beverage supply lines. In another example, a predefined amount can be an amount sufficient to clear each of the selected beverage supply lines of any air pocket between the respective beverage ingredient source and the dispensing nozzle.

Figure 2:
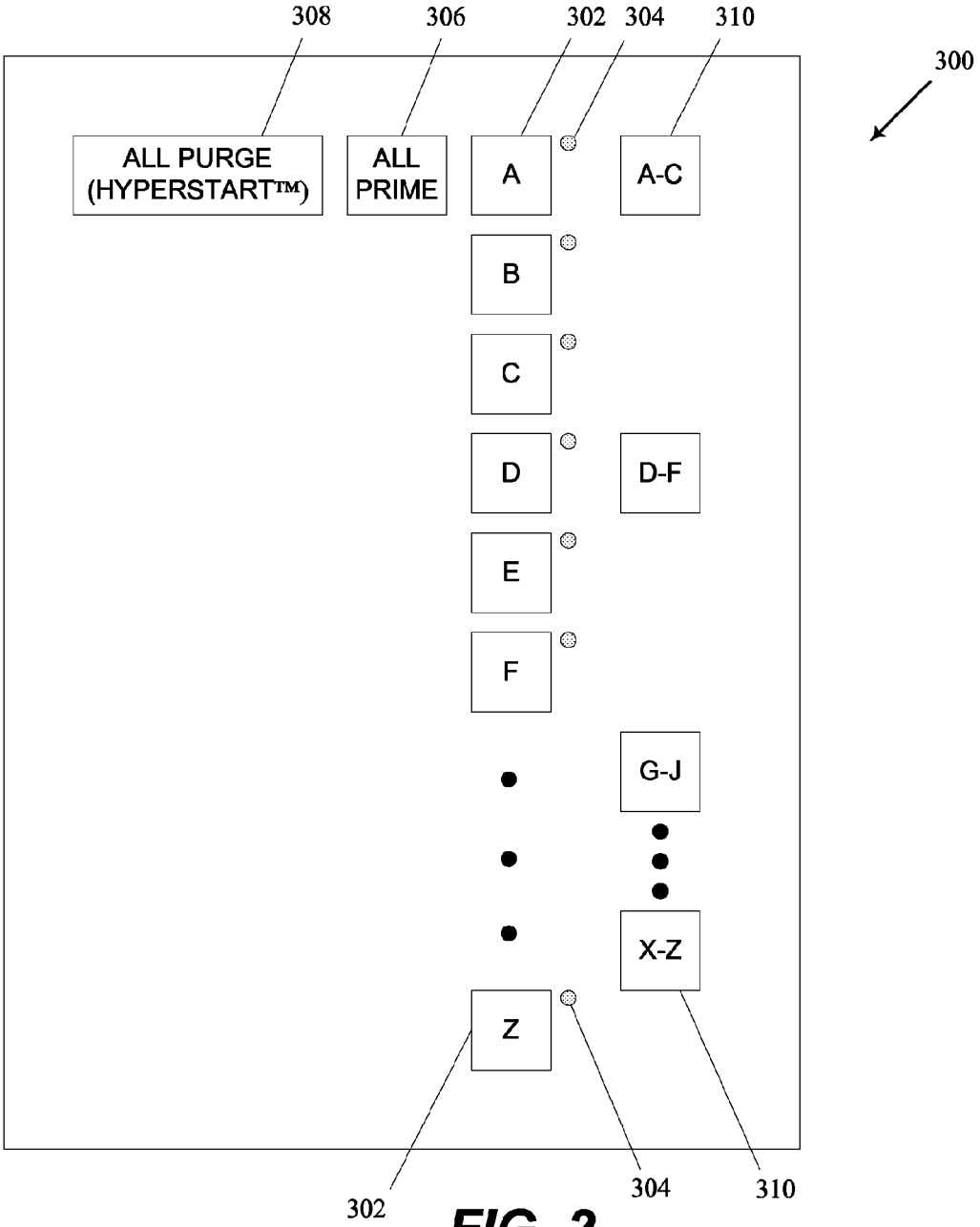
FIG. 2 is a schematic view of an example user interface for use with the product dispenser of FIG. 1, in accordance with an embodiment of the invention.

FIG. 2 shows an embodiment of the user interface 110, an interface 300. As shown, the user interface can be a graphical interface, which may include one or more physical buttons and/or computer generated touch screen display buttons or icons. In any instance, the interface 300 may include one or more predefined product prime buttons 302. Each product prime button 302 may represent a different base product, product component, or ingredient source. When desired, each product prime button 302 can be selected by a user to prime an associated beverage supply line, such as 175, 185, for the particular base product, product component, or ingredient source. Each product prime button 302 may have an indicator 304 that may signal to a user that a certain product or ingredient has been exhausted or is in a "sold out" condition. In this manner, a user can readily observe which base product, product component, or ingredient source may require replacement prior to performing a priming operation after installation of or replacement with a new base product or product component container.

The interface 300 may also include an all prime button 306, which may be used to simultaneously prime all of the associated beverage supply lines, such as 175, 185, for all of the base products, product components, or ingredient sources associated with the product dispenser. In one embodiment, the all prime button 306 can initiate a one button prime command which simultaneously primes all beverage supply lines 175, 185 in the product dispenser. Generally, when the all prime button 306 is used, a product dispenser operator can simultaneously prime multiple beverage supply lines for multiple different base products or product components immediately after installation of or replacement with one or more new base product or product component containers.

The interface 300 may also include an all purge button or Hyperstart™ button 308, which may be used to simultaneously purge some or all of the associated beverage supply lines, such as 175, 185, for all of the base products, product components, or ingredient sources associated with the product dispenser. In one embodiment, the all purge button or Hyperstart™ button 308 can initiate a one button purge command which simultaneously purges all beverage supply lines 175, 185 in the product dispenser. Generally, when the all purge button or Hyperstart™ button 308 is used, a product dispenser operator can simultaneously purge multiple beverage supply lines for multiple different base products or product components immediately after installation of all new base product or product component containers, which is typically done at a new installation of the product dispenser or at a product dispenser manufacturing facility when the entire product dispenser is flushed for cleaning or testing purposes.

Furthermore, the interface 300 may include one or more selectable group prime buttons 310. Each product group button 310 may represent a different group of base products, product components, or ingredient sources. When desired, each product group prime button 310 can be selected by a user to prime associated beverage supply lines, such as 175, 185, for a particular group of base products, product components, or ingredient sources. When the product group prime button 310 is used, a product dispenser operator can simultaneously prime multiple beverage supply lines for a single group of different base products or product components immediately after installation of one or more new base product or product component containers. While the group prime buttons 310 shown in FIG. 2 indicate successive groups of products, such as A-C, D-F, G-J, and X-Z, any number of products can be grouped together or otherwise can be grouped together regardless of any predefined product dispenser order, such as A-Z, in accordance with embodiments of invention. For example, each of the group prime buttons can be independently programmed to group certain selected products together, such as related products, components, or ingredients. One will recognize the applicability of group priming to group purging, and one or more group purging buttons can be provided in other embodiments of a product dispenser.

The interface 300 may provide a user, such as an individual product dispenser operator, with secure access by password, smart card, biometric identification, credit card, RFID, or otherwise. In certain embodiments, the user interface 300 may provide a user with certain product prime buttons corresponding to those base products, product components, or ingredient sources which need or require a priming operation and/or an all prime button which can prime only those base products or product components which need or require a priming operation, and other types of information. In other embodiments, the user interface 300 may provide a user with certain product purge buttons corresponding to those base products, product components, or ingredient sources which need or require a purging operation and/or an all purge button which can purge only those base products, product components, or ingredient sources which need or require a purging operation, and other types of information. In further embodiments, the user interface 300 may restrict and/or allow which and how much of various ingredient sources, base products, or product components may be primed or purged by a user, such as product dispenser operator. User or operator preferences also may be retained and used for future product dispenser maintenance.

In addition to the graphical interface, the product dispenser 100 as a whole may provide other product dispenser statistics and troubleshooting information. For example, the delay time for the start of the pumps 160 or the metering devices 170, the times for the vent and/or flush cycles, the portion cycles, etc. may be accessed through the user interface 110, 300. This interface 110, 300 may be password or otherwise protected. The user interface 110, 300 may communicate and/or be accessed as needed with a network or other source for troubleshooting or repair and for notifications or alerts, for example, of a potential incorrect dose of ingredients.

In use, a user such as a product dispenser operator, for example a food service employee and/or dispenser technician, may select a desired beverage to prime from the user interface 110. The product dispenser 100 thus provides a user with the ability to simultaneously prime or purge associated beverage supply lines for any number of or all of the beverages offered by the product dispenser 100 as desired. The user can select some or all of the ingredients as needed to perform a simultaneous priming or purging operation on the associated beverage supply lines. As such, the user can simultaneously prime or purge all of the beverage supply lines for a product dispenser with a single operation.

In one embodiment, a user can request priming or purging of the beverage supply lines of any number of particular "branded" beverages that may be sold out or for which the associated containers have recently been replaced. For example, icons associated with the "Cherry Coke®" beverage and the "Coca-Cola®" beverage sold by The Coca-Cola Company of Atlanta, Ga. can be displayed on a user interface, such as 300 in FIG. 2, when the product dispenser detects that a priming or purging operation can be performed for the particular beverage and associated beverage supply lines. If desired, the user can prime each beverage supply line by selecting the respective icons, or may decide to select an all prime button, similar to 306, to simultaneously prime all or a selected number of associated beverage supply lines. Furthermore, if desired, the user can purge each beverage supply line by selecting the respective icons, or may decide to select an all purge button, similar to 308, to simultaneously purge all or a selected number of associated beverage supply lines. The product dispenser 100 thus may provide via the user interface 300 as many "branded" beverages as may be available from the product dispenser 100 and/or as may need or otherwise require a priming or purging operation.

The interface 110, with the control device 120, can instruct some or all of the individual pumps 160 and/or the metering devices 170 to dispense suitable ingredients in the appropriate proportions through the beverage supply lines 175, 185 towards the dispensing nozzle 180. The pumps 160 and the metering devices 170 may be pulsed on and off as desired to vary the flow rate, or may otherwise be activated for a predetermined amount of time to introduce a predefined amount of each respective ingredient into the respective beverage supply lines 175, 185. For example, all of the pumps 160 and the metering devices 170 may be activated for about 5 seconds to introduce a predefined amount, such as 5 ml, of each respective ingredient into the respective beverage supply lines 175, 185. In another example, all of the pumps 160 and the metering devices 170 may be activated as needed to introduce a predefined amount of each respective ingredient into the respective beverage supply lines 175, 185 to reset a respective sensor associated with each beverage supply line. In yet another example, all of the pumps 160 and the metering devices 170 may be activated for about 60 seconds to introduce a predefined amount, such as 60 ml, of each respective ingredient into the respective beverage supply lines 175, 185 to purge each beverage supply line. Depending on the type of ingredients and/or beverages, different flow rates and flow timing may be employed, e.g., certain fluid streams may be added early or late, certain fluid streams may be pulsed, etc.

The use of a single button prime operation with the individual pumps 160 and/or the metering devices 170 for the water source 130, the macro-ingredient sources 140, and the macro-ingredient sources 150 provides the ability to simultaneously prime some or all of the ingredients offered by the product dispenser 100. In other words, as opposed to a conventional prime operation where each beverage and/or ingredient had to be primed in successive operations, the product dispenser 100 shown in FIG. 1 can provide for simultaneous priming of some or all of the beverages and/or ingredients as well as their respective beverage supply lines. Likewise, the use of a single button purge operation with the individual pumps 160 and/or the metering devices 170 for the water source 130, the macro-ingredient sources 140, and the macro-ingredient sources 150 provides the ability to simultaneously purge some or all of the ingredients offered by the product dispenser 100. In other words, as opposed to a conventional purge operation where each beverage and/or ingredient had to be purged in successive operations, the product dispenser 100 shown in FIG. 1 can provide for simultaneous purging of some or all of the beverages and/or ingredients as well as their respective beverage supply lines. Embodiments of the invention thus have applicability to conventional countertop devices, vending devices, and various types of bottling and filling devices. Although embodiments of the invention are described in terms of the product dispenser 100, embodiments of the invention are applicable to the combination of any types of ingredients, wet or dry. For example, commonly owned U.S. patent application Ser. No. 11/276,549, entitled "Juice Dispensing System", is specifically directed towards certain concepts related to the juice field. One may recognize the applicability of embodiments of the invention to the technology described in U.S. patent application Ser. No. 11/276,549.

Referring again to FIG. 1, the product dispenser 100 also may include a user data system 400 in communication with the user interface 110 and the control device 120. The user data system 400 may include a communication device 410. The communication device 410 may include a video touch screen, a video screen and keyboard, or any other type of conventional input/output device. The communications device 410 may be part of the user interface 110 or a separate element.

The communications device 410 may prompt the user to input data on various types of biometric and/or other types of information. Based upon the user's input, the control device 120 may analyze the data and may convert the user's input to one or more priming or purging commands.

Based upon the inputted data, the communications device 410 of the consumer data system 400 may initiate a product prime button command, an all prime button command and/or a group prime button command, an all purge button command and/or a group purge button command, similar to those offered by 302, 306, 308, and 310 described above with respect to FIG. 2. Once a priming or purging command is selected, the appropriate micro-ingredients 150 or other elements may be dispensed via the pumps 160 and the metering devices 160 as described above.

In addition to the communications device 410 as described above, the user data system 400 also may include one or more biometric sensors 420. The biometric sensors may include automated devices to gather the desired user biometric data or other information. The biometric sensors 420 may include a scale, a blood pressure cuff, a breathalyzer, a blood analyzer, a hair analyzer, an EKG, etc. Any type of monitoring device may be used herein. Any number of biometric sensors 420 may be used together. The biometric sensors 420 may be in communication with the control device 120 as described above.

Figure 3:
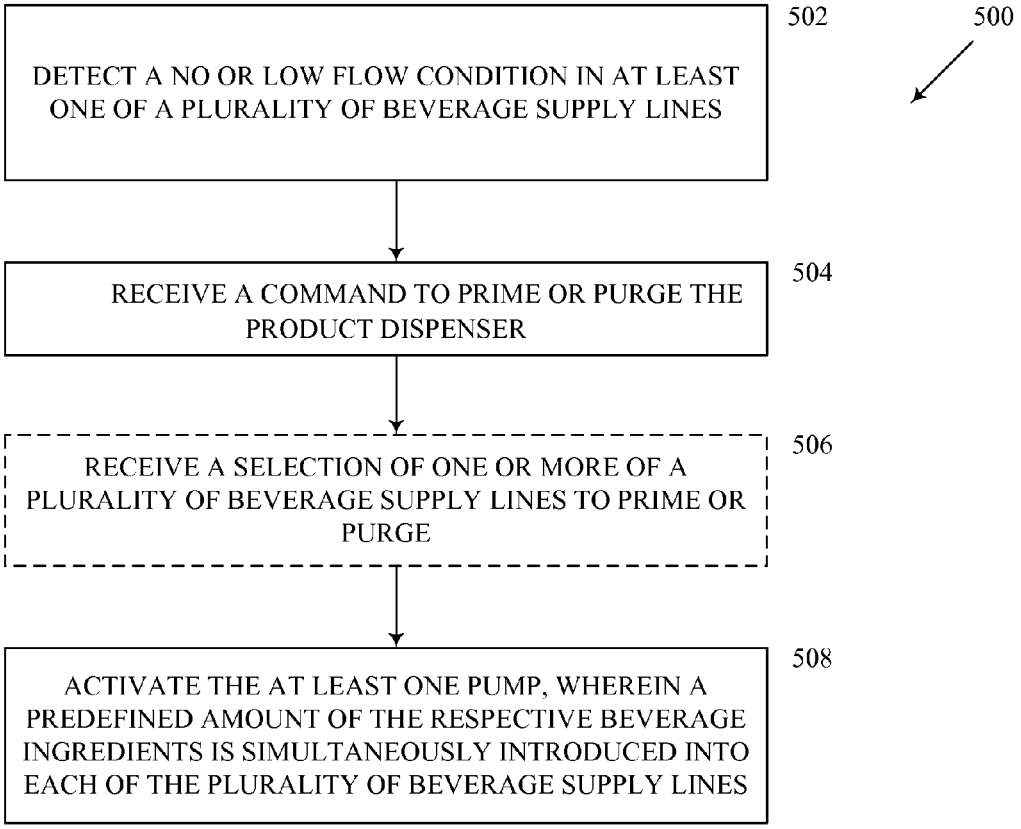
FIG. 3 is a schematic flowchart for a method for using a product dispenser in accordance with an embodiment of the invention.

FIG. 3 is a process flowchart illustrating an example method in accordance with an embodiment of the invention. The example method 500 shown in FIG. 3 provides a method for operating a product dispenser. In particular, the method 500 is a method for operating a product dispenser with a plurality of beverage ingredient sources comprising a respective beverage ingredient, a plurality of beverage supply lines in respective communication with the plurality of ingredient sources, and at least one pump in communication with the plurality of beverage supply lines. The method 500 can be implemented by various system or product dispenser components shown in FIG. 1, such as 100 of FIG. 1.

The method 300 begins at block 502. In block 502, a no or low flow condition in at least one of the plurality of beverage supply lines is detected. For example, in the embodiment shown with reference to FIGS. 1 and 2, one or more sensors, such as 165, can detect when a no or low flow condition exists with one or more of the plurality of beverage supply lines, such as 175, 185. A control device, such as 120, can receive a signal from the one or more sensors 165 when a no or low flow condition is detected, and the control device 120 can generate a corresponding signal to output via a user interface, such as 304.

Block 502 is followed by block 504, in which a command to prime or purge the product dispenser is received. For example, in the embodiment shown with reference to FIGS. 1 and 2, a user can input a prime command via the interface 110, such as inputting the all prime button 306 in FIG. 2. A control device, such as 120, can receive the prime command from the interface 110, and can facilitate activation of one or more individual pumps 160 and/or the metering devices 170 for some or all desired ingredients and/or sources 130, 140, 150. In another example, a user can input a purge command via the interface 110, such as inputting an all purge or the Hyperstart™ button 308 in FIG. 2. A control device, such as 120, can receive the purge command from the interface 110, and can facilitate activation of one or more individual pumps 160 and/or the metering devices 170 for some or all desired ingredients and/or sources 130, 140, 150.

In one aspect of an embodiment, a command is received via a user interface, wherein a user can initiate the command to prime or purge the product dispenser with a single user command entry.

In one aspect of an embodiment, a plurality of beverage supply lines can be in communication with at least one of the following: one or more ingredient packages; one or more ingredient cartridges, one or more beverage boxes, one or more beverage bags, or one or more beverage containers.

Block 504 is followed by optional block 506, in which a selection of one or more of the plurality of beverage supply lines can be received. For example, in the embodiment shown in FIGS. 1 and 2, a user can input a group prime command via the interface 110, such as inputting the group prime button 308 in FIG. 2, selecting products A-C. A control device, such as 120, can receive the group prime command from the interface 110, and can facilitate activation the respective individual pumps 160 and/or the metering devices 170 for the respective ingredients and/or sources 130, 140, 150 corresponding with the group of products A-C. In another example, a group purge command could be input, and a control device, such as 120, can receive the group purge command from the interface, and can facilitate activation the respective individual pumps and/or the metering devices for the respective ingredients and/or sources corresponding with the selected group of products.

Optional block 506 is followed by block 508, in which the at least one pump is activated, wherein a predefined amount of the respective beverage ingredients is simultaneously introduced into each of the plurality of beverage supply lines. For example, in the embodiment shown in FIGS. 1 and 2, the control device 120 can activate one or more individual pumps 160 and/or the metering devices 170 for some or all desired ingredients and/or sources 130, 140, 150. In this embodiment, the respective pumps 160 and/or the metering devices 170 can be activated or otherwise pulsed on and off until a predefined amount of the respective beverage ingredients is simultaneously introduced into each of the plurality of beverage supply lines, such as 175, 185. For example, all of the pumps 160 and the metering devices 170 may be activated for about 5 seconds to introduce a predefined amount, such as 5 ml, of each respective ingredient into the respective beverage supply lines 175, 185. In another example, all of the pumps 160 and the metering devices 170 may be activated for about 60 seconds to introduce a predefined amount, such as 60 ml, of each respective ingredient into the respective beverage supply lines 175, 185.

In one aspect of an embodiment, a product dispenser can include a dispensing nozzle, wherein the predefined amount comprises an amount sufficient to clear each of the plurality of beverage supply lines of any air pocket between the respective beverage ingredient source and the dispensing nozzle.

In one aspect of an embodiment, a predefined amount can include an amount sufficient to clear each of the plurality of beverage supply lines of any air pocket between the respective beverage ingredient source and a respective sensor associated with each of the plurality of beverage supply lines.

In one aspect of an embodiment, a predefined amount of the respective beverage ingredients is based at least in part on operating the at least one pump for a predefined time.

In one aspect of an embodiment, one or more individual pumps can include a respective pump for each of the plurality of beverage ingredient sources, and the method can further include activating each of the respective pumps, wherein a predefined amount of the respective beverage ingredients is simultaneously introduced into each of the plurality of beverage supply lines.

In one aspect of an embodiment, upon receipt of a selection of the plurality of beverage supply lines to prime or purge, a predefined amount of the respective beverage ingredients is simultaneously introduced into the selected plurality of beverage supply lines.

The method 500 of FIG. 3 ends after block 508.

The example elements of FIG. 3 is shown by way of example, and other process embodiments can have fewer or greater numbers of elements, and such elements can be arranged in alternative configurations in accordance with other embodiments of the invention. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer such as a switch, or other programmable data processing apparatus to produce a machine, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational elements or steps to be performed on the computer or other programmable apparatus to produce a computer implemented process such that the instructions that execute on the computer or other programmable apparatus provide elements for implementing the functions specified in the flowchart block or blocks.

Accordingly, blocks of the block diagrams and flowchart illustrations support combinations of means for performing the specified functions, combinations of elements or steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions, elements, or combinations of special purpose hardware and computer instructions.

The capabilities of various embodiments of the invention can be implemented in software, firmware, hardware or some combination thereof.

As one example, one or more aspects of the invention can be included in an article of manufacture (e.g., one or more computer program products) having, for instance, computer usable media. The media has embodied therein, for instance, computer readable program code means for providing and facilitating the capabilities of the embodiment of the invention. The article of manufacture can be included as a part of a computer system or sold separately.

Additionally, at least one program storage device readable by a machine, tangibly embodying at least one program or set of instructions executable by the machine to perform the capabilities of the embodiment of the invention can be provided.

The flow diagrams depicted herein are examples. There may be many variations to these diagrams or the elements (or operations) described therein without departing from the scope of the claimed invention. For instance, the elements may be performed in a differing order, or elements may be added, deleted or modified. All of these variations are considered a part of the claimed inventions.

While embodiments of the invention have been described, it will be understood that those skilled in the art, both now and in the future, may make various improvements and enhancements which fall within the scope of the claims which follow. These claims should be construed to maintain the proper protection for the invention first described.

The invention claimed is:

1. A product dispenser, comprising:

a plurality of beverage ingredient sources comprising a respective beverage ingredient;

a plurality of beverage supply lines in respective communication with the plurality of ingredient sources;

a plurality of pumps in communication with the plurality of beverage supply lines; and a controller in communication with the plurality of pumps and operable to execute a set of instructions operable to:

receive a single user command entry to simultaneously prime or purge the plurality of beverage supply lines in the product dispenser; and activate the plurality of pumps, wherein a predefined amount of the respective beverage ingredients is simultaneously introduced into each of the plurality of beverage supply lines.

2. The dispenser of claim 1, further comprising a user interface, wherein a user can initiate the command to prime or purge the product dispenser with a single user command entry.

3. The dispenser of claim 1, further comprising at least one sensor operable to detect no or low flow in the plurality of beverage supply lines, wherein the controller is further operable to execute a set of instructions for generating an indication that a no or low flow condition exists with at least one of the plurality of beverage supply lines.

4. The dispenser of claim 1, wherein the plurality of beverage supply lines are in communication with at least one of the following: one or more ingredient packages; one or more ingredient cartridges, one or more beverage boxes, one or more beverage bags, or one or more beverage containers.

5. The dispenser of claim 1, wherein the predefined amount comprises an amount sufficient to clear each of the plurality of beverage supply lines of any air pocket between the respective beverage ingredient source and a respective sensor associated with each of the plurality of beverage supply lines.

6. The dispenser of claim 1, further comprising a dispensing nozzle, wherein the predefined amount comprises an amount sufficient to clear each of the plurality of beverage supply lines of any air pocket between the respective beverage ingredient source and the dispensing nozzle.

7. The dispenser of claim 1, wherein the predefined amount of the respective beverage ingredients is based at least in part on operating the plurality of pumps for a predefined time.

8. The dispenser of claim 1, wherein the plurality of pumps comprises a respective pump for each of the plurality of beverage ingredient sources, wherein the controller is in communication with each of the respective pumps and operable to execute a set of instructions operable to:

activate each of the respective pumps, wherein a predefined amount of the respective beverage ingredients is simultaneously introduced into each of the plurality of beverage supply lines.

9. The dispenser of claim 1, wherein the controller is operable to execute a set of instructions further operable to:

receive a selection of the plurality of beverage supply lines to prime or purge; wherein each of the plurality of beverage supply lines into which a predefined amount of the respective beverage ingredients is simultaneously introduced is the selected plurality of beverage supply lines.

10. A method for priming or purging a product dispenser, comprising:

providing a plurality of beverage ingredient sources comprising a respective beverage ingredient;

providing a plurality of beverage supply lines in respective communication with the plurality of ingredient sources;

providing a plurality of pumps in communication with the plurality of beverage supply lines; and providing a controller in communication with the plurality of pumps and operable to execute a set of instructions operable to:

receive a single user command entry to simultaneously prime or purge the plurality of beverage supply lines in the product dispenser; and activate the plurality of pumps, wherein a predefined amount of the respective beverage ingredients is simultaneously introduced into each of the plurality of beverage supply lines.

11. The method of claim 10, further comprising providing a user interface, wherein a user can initiate the command to prime or purge the product dispenser with a single user command entry.

12. The method of claim 10, further comprising providing at least one sensor operable to detect no or low flow in the plurality of beverage supply lines, wherein the controller is further operable to execute a set of instructions for generating an indication that a no or low flow condition exists with at least one of the plurality of beverage supply lines.

13. The method of claim 10, wherein the plurality of beverage supply lines are in communication with at least one of the following: one or more ingredient packages; one or more ingredient cartridges, one or more beverage boxes, one or more beverage bags, or one or more beverage containers.

14. The method of claim 10, further comprising providing a dispensing nozzle, wherein the predefined amount comprises an amount sufficient to clear each of the plurality of beverage supply lines of any air pocket between the respective beverage ingredient source and the dispensing nozzle.

15. The method of claim 10, wherein the predefined amount comprises an amount sufficient to clear each of the plurality of beverage supply lines of any air pocket between the respective beverage ingredient source and a respective sensor associated with each of the plurality of beverage supply lines.

16. The method of claim 10, wherein the predefined amount of the respective beverage ingredients is based at least in part on operating the plurality of pumps for a predefined time.

17. The method of claim 10, wherein the plurality of pumps comprises a respective pump for each of the plurality of beverage ingredient sources, wherein the controller is in communication with each of the respective pumps and operable to execute a set of instructions operable to:

activate each of the respective pumps, wherein a predefined amount of the respective beverage ingredients is simultaneously introduced into each of the plurality of beverage supply lines.

* * * * *